US010179468B2

(12) United States Patent
Tarver et al.

(10) Patent No.: US 10,179,468 B2
(45) Date of Patent: Jan. 15, 2019

(54) DRYING MEDIA

(71) Applicant: HEWLETT-PACKARD DEVELOPMENT COMPANY, L.P., Houston, TX (US)

(72) Inventors: Gary Tarver, Corvallis, OR (US); Jayanta C Panditaratne, San Diego, CA (US); Jason Cassidy Hower, Corvallis, OR (US); Hua Tan, Vancouver, WA (US); James Kearns, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 15/122,594

(22) PCT Filed: Mar. 14, 2014

(86) PCT No.: PCT/US2014/028416
§ 371 (c)(1),
(2) Date: Nov. 2, 2016

(87) PCT Pub. No.: WO2015/137973
PCT Pub. Date: Sep. 17, 2015

(65) Prior Publication Data
US 2017/0072725 A1 Mar. 16, 2017

(51) Int. Cl.
*B41M 5/00* (2006.01)
*B41J 11/00* (2006.01)
*B41J 29/377* (2006.01)

(52) U.S. Cl.
CPC ..... *B41M 5/0011* (2013.01); *B41J 11/002* (2013.01); *B41J 29/377* (2013.01)

(58) Field of Classification Search
CPC ..... B41M 5/0011
(Continued)

(56) References Cited

U.S. PATENT DOCUMENTS 3,874,091 A * 4/1975 Fukumoto ..... B41F 23/0426 34/652
5,502,788 A 3/1996 Platsch
6,412,190 B1 7/2002 Smith
(Continued)

FOREIGN PATENT DOCUMENTS

EP 1162518 A2 12/2001
EP 1336500 A2 8/2003
(Continued)

OTHER PUBLICATIONS

Seyed-Yagoobi, et al. . An Experimental Study of Gas Fired Infrared Drying of Paper. Feb. 6, 2007.

*Primary Examiner* — Anthony Nguyen
(74) *Attorney, Agent, or Firm* — HP Inc. Patent Department

(57) ABSTRACT

A drying apparatus usable with a printing system includes a housing, a first set of radiative heating elements, a second set of radiative heating elements, and an air handling device. The housing includes a front region and a rear region adjacent to the front region. The front region includes an inlet to receive media. The rear region includes an outlet to pass media there through. The first set of radiative heating elements is disposed within the front region to heat the media. The second set of radiative heating elements is disposed within the rear region to heat the media. The air handling device is disposed across from the second set of radiative heating elements to jet air within the rear region to cool the media prior to the media being passed through the outlet.

20 Claims, 6 Drawing Sheets

(58) Field of Classification Search
USPC ..... 101/424.1
See application file for complete search history.

(56) References Cited

U.S. PATENT DOCUMENTS

| | | | | |
|---|---|---|---|---|
| 7,222,953 | B2 * | 5/2007 | Yokoyama | B41J 11/002 347/102 |
| 7,966,743 | B2 | 6/2011 | Piatt et al. | |
| 8,807,736 | B1 * | 8/2014 | Walker | B41J 11/002 347/102 |
| 2003/0121440 | A1 * | 7/2003 | Koch | B41F 23/0483 101/487 |
| 2003/0142189 | A1 | 7/2003 | Aukerman | |
| 2004/0044897 | A1 | 3/2004 | Lim | |
| 2007/0289466 | A1 | 12/2007 | Bock et al. | |
| 2009/0244146 | A1 * | 10/2009 | Chiwata | B41J 11/002 347/14 |
| 2010/0058609 | A1 * | 3/2010 | Taguchi | B41C 1/1083 34/443 |
| 2011/0036255 | A1 | 2/2011 | Monclus et al. | |
| 2012/0098878 | A1 * | 4/2012 | Sanekata | B41J 11/002 347/1 |
| 2012/0176439 | A1 | 7/2012 | Kanai et al. | |
| 2013/0321542 | A1 | 5/2013 | Velasco et al. | |
| 2013/0194367 | A1 * | 8/2013 | Chiwata | B41J 11/0015 347/102 |
| 2014/0240417 | A1 * | 8/2014 | Toya | B41J 15/04 347/102 |

FOREIGN PATENT DOCUMENTS

| | | |
|---|---|---|
| JP | H058373 | 1/1993 |
| KR | 20040044897 | 5/2004 |
| KR | 20100043978 | 4/2010 |

* cited by examiner

DRYING MEDIA

BACKGROUND

Printing systems may include printing stations and drying stations. The printing station may include printheads to apply printing fluid on media to form images. The drying stations may include heaters to heat printing fluid on the media.

BRIEF DESCRIPTION OF THE DRAWINGS

Non-limiting examples of the present disclosure are described in the following description, read with reference to the figures attached hereto and do not limit the scope of the claims. In the figures, identical and similar structures, elements or parts thereof that appear in more than one figure are generally labeled with the same or similar references in the figures in which they appear. Dimensions of components, layers, substrates and features illustrated in the figures are chosen primarily for convenience and clarity of presentation and are not necessarily to scale. Referring to the attached figures:

DETAILED DESCRIPTION

Printing systems may include printing stations and drying stations. The printing station may include printheads to apply printing fluid on media to form images. The printing fluid may include latex ink, ultraviolet (UV) curable ink, and the like. The drying stations may include heaters disposed downstream of a printing station to heat printed media. The drying stations may also include heaters disposed upstream of the printing station to heat media before it is printed on. Heating the media upstream of the printing station, however, may distort the media and significantly increase heat applied to downstream components of the printing system. Also, ramping up and maintaining the drying system to a target temperature may delay the printing of the media and consume a lot of power. Thus, image quality, lifespan of such downstream components, and throughput may be reduced.

In examples, a drying apparatus usable with a printing system includes a housing, a first set of radiative heating elements, a second set of radiative heating elements, and an air handling device. The housing includes a front region and a rear region adjacent to the front region. The front region includes an inlet to receive media. The rear region includes an outlet to pass media there through. The first set of radiative heating elements is disposed within the front region to heat the media. The second set of radiative heating elements is disposed within the rear region to heat the media.

The air handling device is disposed across from the second set of radiative heating elements to jet air within the rear region to cool the media prior to passing the media through the outlet. Also, the first and second set of radiative heating elements may be able to ramp up to the target temperature in a timely and cost-efficient manner. Accordingly, a combination of radiative heating elements and an air handling device to jet air at media at a high velocity and strategically placed at a latter portion of the housing may increase image quality and lifespan of such downstream components.

Figure 1:
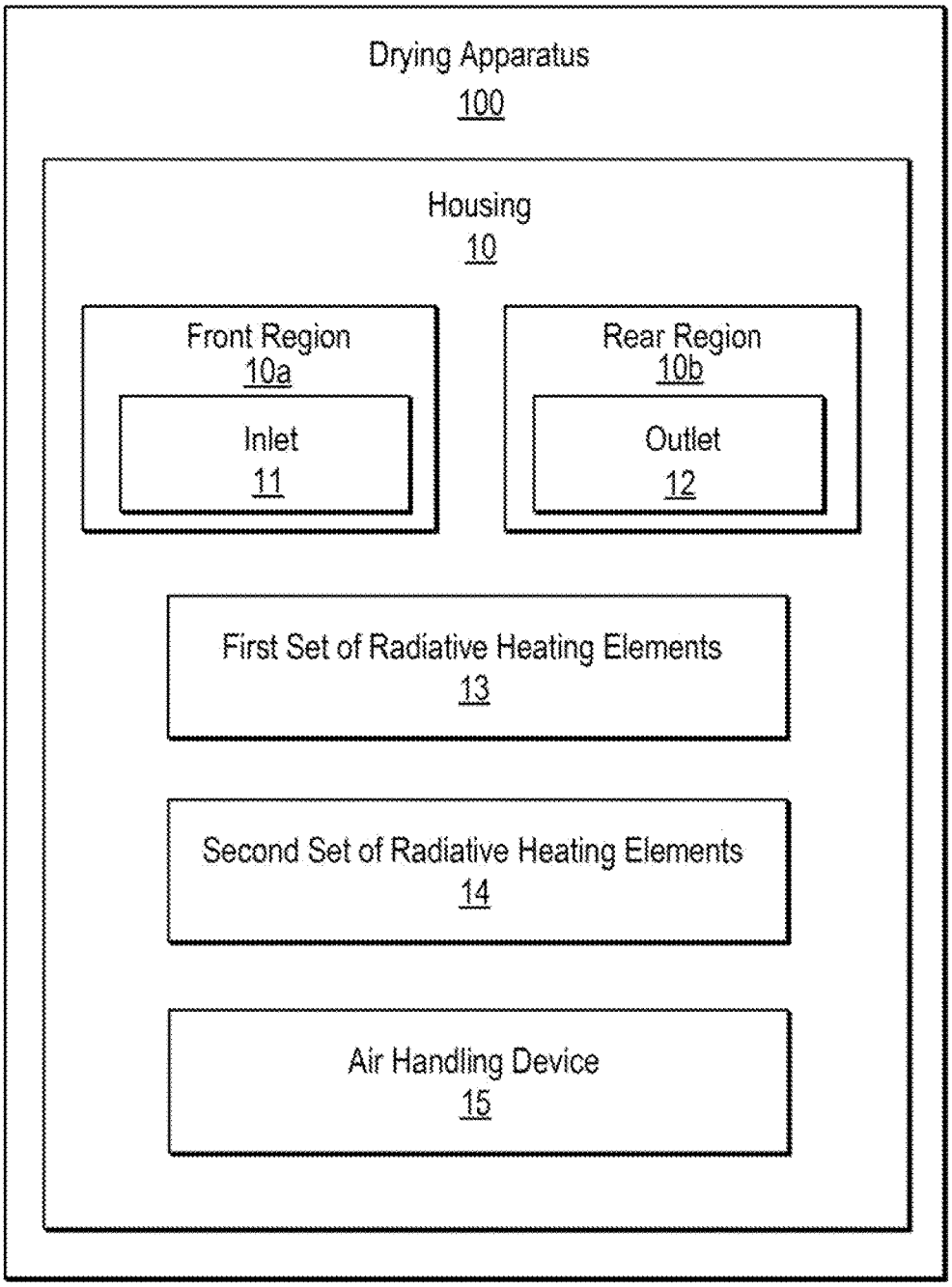
FIG. 1 is a block diagram illustrating a drying apparatus according to an example.

FIG. 1 is a block diagram illustrating a drying apparatus according to an example. A drying apparatus 100 may be usable with a printing system. Referring to FIG. 1, in some examples, the drying system 100 includes a housing 10, a first set of radiative heating elements 13, a second set of radiative heating elements 14, and an air handling device 15. The housing 10 includes a front region 10*a* and a rear region 10*b* adjacent to the front region 10*a*. That is, the front region 10*a* may be upstream from the rear region 10*b* in a media transport direction through the housing 10. The front region 10*a* includes an inlet 11 to receive media. The rear region 10*b* includes an outlet 12 to pass media there through. The first set of radiative heating elements 13 is disposed within the front region 10*a* to heat the media. The second set of radiative heating elements 14 is disposed within the rear region 10*b* to heat the media.

Referring to FIG. 1, in some examples, the air handling device 15 is disposed across from the second set of radiative heating elements 14 to jet air within the rear region 10*b* to cool the media prior to passing the media through the outlet 12. For example, the air handling device 15 may be disposed in the rear region 10*b* of the housing 10. In some examples, the first and second set of radiative heating elements 13 and 14 may be integrally formed, for example, as a unitary member. The first and second set of radiative heating elements 13 and 14 may include resistive heating elements, infrared lamps, and the like.

Figure 2:
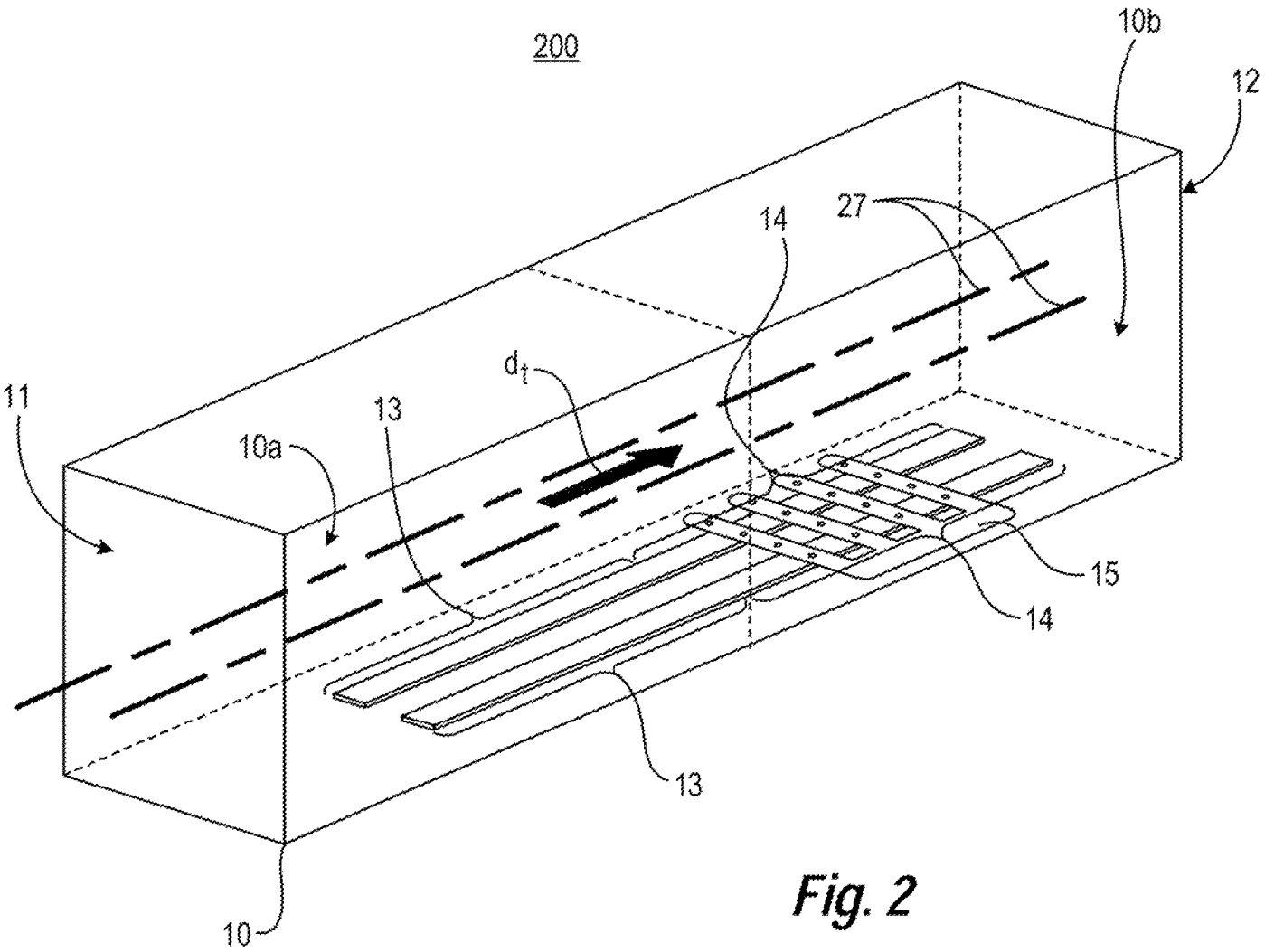
FIG. 2 is a schematic view of drying apparatus according to an example.
Figure 3:
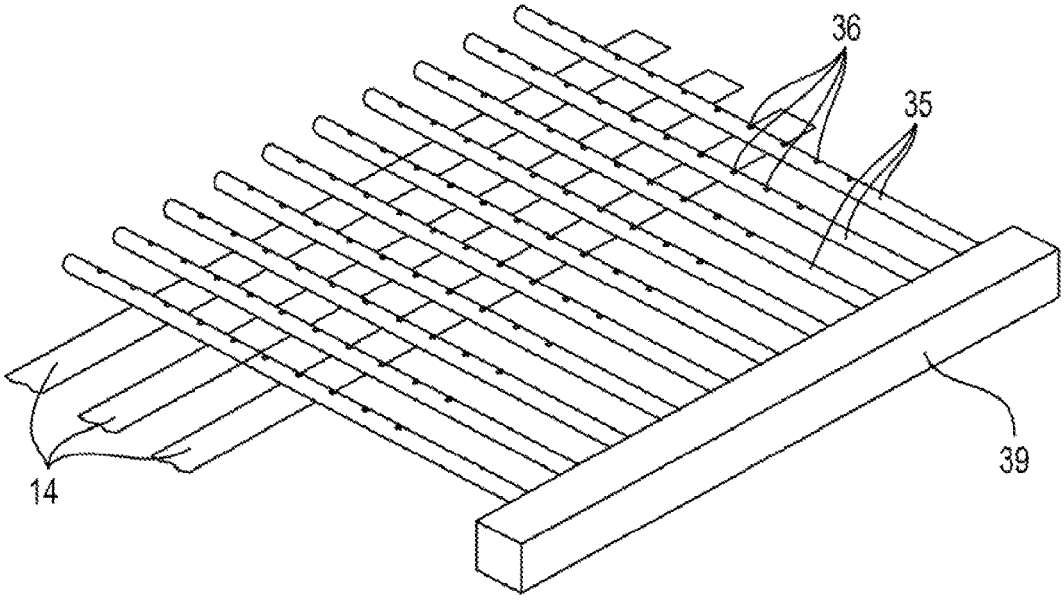
FIG. 3 is a schematic view of a second set of radiative heating elements and air bars disposed within a second region of the drying apparatus of FIG. 2 according to an example.
Figure 4:
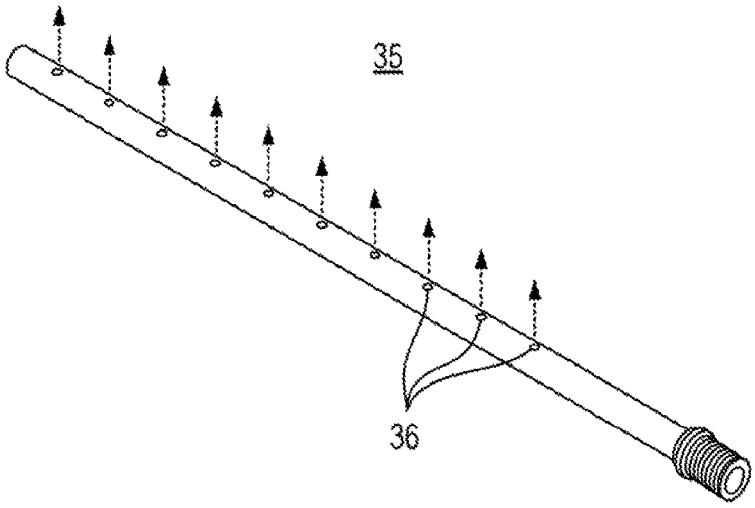
FIG. 4 is a schematic view of an air bar of the drying apparatus of FIG. 2 according to an example.

FIG. 2 is a schematic view illustrating a drying apparatus according to an example. FIG. 3 is a schematic view of a second set of radiative heating elements and air bars disposed within a second region of the drying apparatus of FIG. 2 according to an example. FIG. 4 is a schematic view illustrating an air bar of the drying apparatus of FIG. 2 according to an example. Referring to FIGS. 2-4, the drying apparatus 200 may include the housing 10, the first set of radiative heating elements 13, the second set of radiative heating elements 14, and the air handling device 15 as previously discussed with respect to the drying apparatus 100 of FIG. 1. In some examples, the first and second set of radiative heating elements 13 and 14 may be integrally formed, for example, as a unitary member.

Referring to FIG. 2, in some examples, the housing 10 may also include a media transport path 27. That is, the media may enter the housing 10 through the inlet 11 thereof. The media may move along the media transport path 27 of the housing 10 in a media transport direction $d_t$ by passing the media through the front region 10*a* and, subsequently, through the rear region 10*b*. The media exits the housing 10 by passing through the outlet 10*b*. In some examples, a media exit temperature of the media passing through the outlet 12 is lower than a front region media temperature of the media within the front region 10*a*. A front region media temperature corresponds to a temperature of the media when it is in the front region 10*a*. A media exit temperature corresponds to a temperature of the media when it is exiting the housing 10 by passing through the outlet 12. For example, the media exit temperature of the media passing through the outlet 12 may be in a range 60 to 75° C., such as about 60° C.

Referring to FIGS. 3 and 4, in some examples, the air handling device 15 may include a plurality of air bars 35. The air bars 35 may be disposed in the rear region 10*b* the housing 10. In some examples, the air bars 35 may be impinging air bars. Each air bar 35 may include a plurality of nozzles 36 to jet the air, for example, at the media. The air bars 35 may be coupled to an air manifold 39. In some examples, a respective air velocity of the air jetted from each of the nozzles 36 of a respective air bar 35 are uniform with respect to each other and support the media within the housing 10. The air handling device 15 such as the set of air bars 35 may jet the air at a velocity in a range from 40 to 90 meters per second. The air bars 35 jetting air at a high velocity within the rear region 10*b* may lower vapor pressure in an area adjacent to the media and within the rear region 10*b*. Additionally, the air bars 35 may jet air at a high velocity within the rear region 10*b* and, in doing so, increase a mass transfer coefficient and a heat transfer coefficient of the rear region 10*b* to increase drying capacity. For example, increasing an air velocity by the air bars 35 may break through a laminar boundary layer of air along the media and, thus, allow a higher mass transfer coefficient in the rear region 10*b*.

Referring to FIGS. 3-4, the air bars 35 may be disposed between the media transport path 27 and the second set of radiative heating elements 14. In some examples, some of the air bars may be positioned above the media transport path 27 and other air bars may be positioned below the media transport path 27. The media exit temperature may be controlled by the combination of the second set of radiative heating elements 14 and air bars 35. That is, the air bars 35 arranged in the rear region 10*b* of the housing 10 may jet air within the rear region 10*b* to cool the media prior to the media being passed through the outlet 12. In some examples, the set of air bars 35 may include 10 air bars, and each air bar 35 may include ten equally-spaced nozzles 36. In some examples, the air bars 35 and radiative heating elements 14 may operate as the media is moving at its operational speed such as about 400 feet per second.

Figure 5:
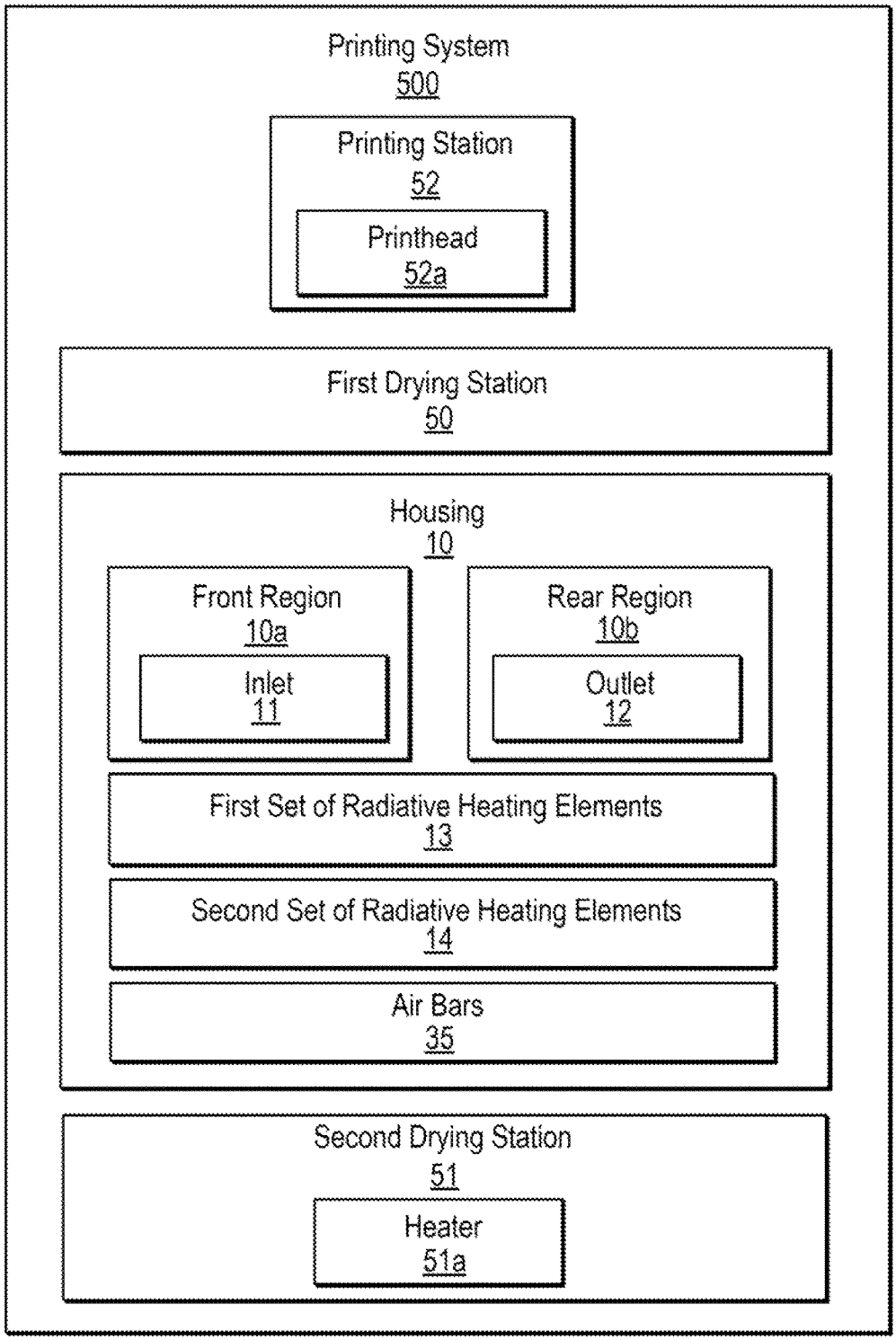
FIG. 5 is a block diagram illustrating a printing system according to an example.
Figure 6:
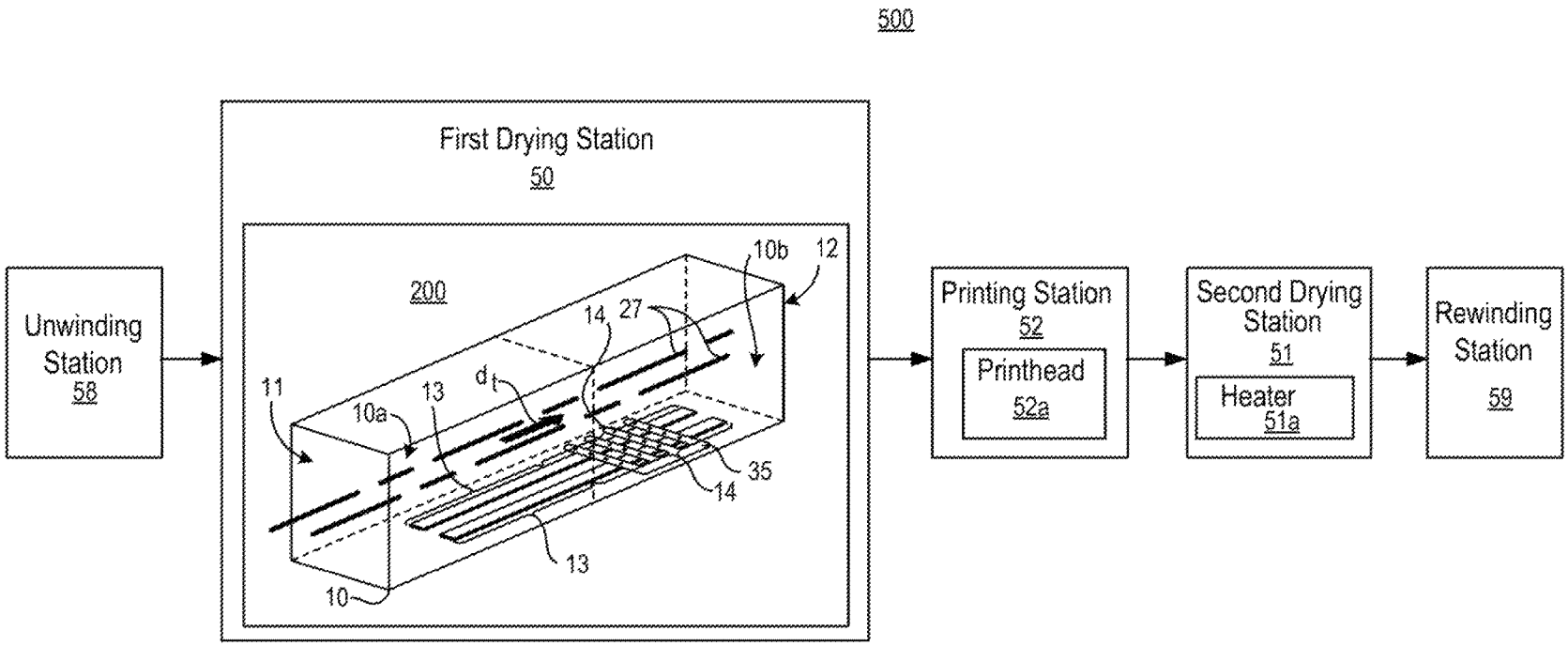
FIG. 6 is a schematic view illustrating the printing system of FIG. 5 according to an example.

FIG. 5 is a block diagram illustrating a printing system according to an example. FIG. 6 is a schematic view illustrating the printing system of FIG. 5 according to an example. Referring to FIGS. 5 and 6, in some examples, a printing system 500 includes a printing station 52, a first drying station 50, and a second drying station 51. The printing station 52 includes at least one printhead 52*a* to print on a media to form a printed media. The first drying station 50 is upstream from the printing station 52 in a media transport direction $d_t$ to heat the media before the media is printed on by the printing station 52. The first drying station 50 may include a housing 10 having a front region 10*a* and a rear region 10*b* adjacent to the front region 10*a*. The front region 10*a* may include an inlet 11 to receive the media. The rear region 10*b* may include an outlet 12 to pass the media there through.

Referring to FIGS. 5 and 6, in some examples, the first drying station 50 may also include a first set of radiative heating elements 13, a second set of radiative heating elements 14, and a plurality of air bars 35. The first set of radiative heating elements 13 is disposed within the front region 10*a* to heat the media. The second set of radiative heating elements 14 is disposed within the rear region 10*b* to heat the media. The air bars 35 are disposed across from the second set of radiative heating elements 14 in which each air bar 35 includes a plurality of nozzles 36 to jet air within the rear region 10*b* to cool the media prior to the media being passed through the outlet 12. The second drying station 51 includes a heater 51*a* to heat the printed media.

Referring to FIG. 6, in some examples, the printing system 500 may also include an unwinding station 58 and a rewinding station 59. For example, the media may be in the form of a web and stored as a roll on an unwinding station 58. A leading edge of the media may be coupled to a rewinding station 59 to rewind the media thereon received from the unwinding station 58. That is, in some examples, the media is sequentially passed from the unwinding station 58, to the first drying station 50, to the printing station 52, to the second drying station 51, and to the rewinding station 59. In some examples, the first heating station 50 also includes a media transport path 27 in which the media is transported in a media transport direction $d_t$. The air bars 35 may be disposed between the media transport path 27 and the second set of radiative heating elements 14 to jet the air at a velocity, for example, in a range from 40 to 90 meters per second. The air bars 35 jetting air at a high velocity within the rear region 10*b* may lower vapor pressure in an area adjacent to the media and within the rear region 10*b*. Additionally, the air bars 35 may jet air at a high velocity within the rear region 10*b* and, in doing so, increase a mass transfer coefficient and a heat transfer coefficient of the rear region 10*b* to increase the drying capability. The printing station 52 may include at least one printhead 52*a* to print on the media.

Figure 7:
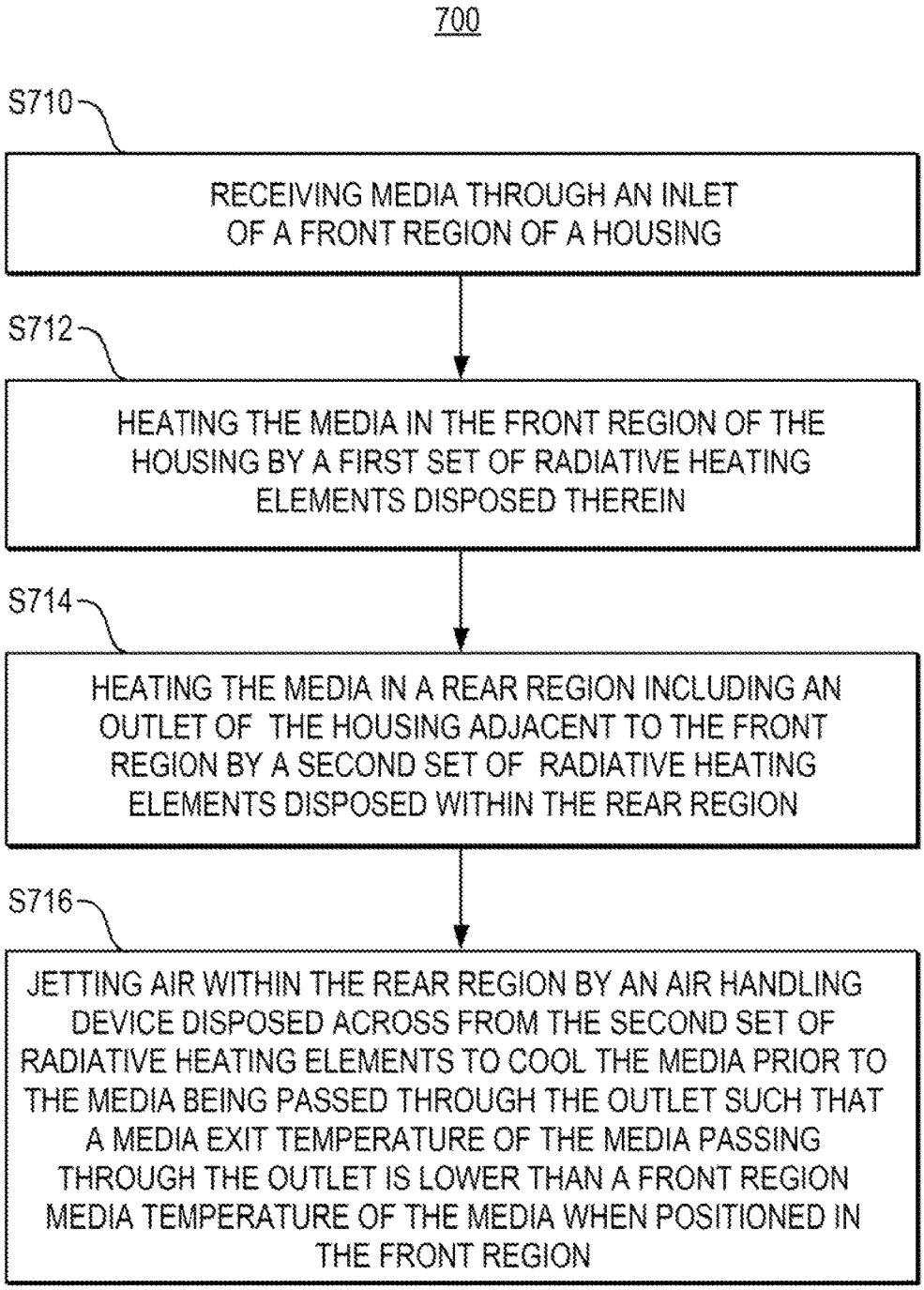
FIG. 7 is a flowchart illustrating a method of drying media according to an example.

FIG. 7 is a flowchart illustrating a method of drying media according to an example. Referring to FIG. 7, in block S710, media is received through an inlet of a front region of a housing. In block S712, the media is heated in the front region of the housing by a first set of radiative heating elements disposed therein. In some examples, heating the media in the front region of the housing by a first set of radiative heating elements disposed therein is performed to preheat the media prior to the media being printed on. In block S714, the media is heated in a rear region including an outlet of the housing adjacent to the front region by a second set of radiative heating elements disposed within the rear region. In some examples, heating the media in the rear region by a second set of radiative heating elements disposed within the rear region is performed to preheat the media prior to the media being printed on.

In block S716, air within the rear region is jetted by an air handling device disposed across from the second set of radiative heating elements to cool the media prior to the media being passed through the outlet such that a media exit temperature of the media exiting the outlet is lower than a front region media temperature of the media when positioned in the front region. For example, the air may be jetted at an air velocity from each of the nozzles of a respective air bar of the air handling device in a uniform manner with respect to each other to support the media within the housing. Additionally, the air may be jetted at a velocity in a range from 40 to 90 meters per second. In some examples, jetting air within the rear region by an air handling device includes lowering vapor pressure in an area adjacent to the media and within the rear region. Additionally, in some examples, jetting the air within the rear region by an air handling device includes increasing a mass transfer coefficient and a heat transfer coefficient of the rear region to increase the drying capacity.

It is to be understood that the flowchart of FIG. 7 illustrates architecture, functionality, and/or operation of examples of the present disclosure. If embodied in software, each block may represent a module, segment, or portion of code that includes one or more executable instructions to implement the specified logical function(s). If embodied in hardware, each block may represent a circuit or a number of interconnected circuits to implement the specified logical function(s). Although the flowchart of FIG. 7 illustrates a specific order of execution, the order of execution may differ from that which is depicted. For example, the order of execution of two or more blocks may be rearranged relative to the order illustrated. Also, two or more blocks illustrated in succession in FIG. 7 may be executed concurrently or with partial concurrence. All such variations are within the scope of the present disclosure.

The present disclosure has been described using non-limiting detailed descriptions of examples thereof and is not intended to limit the scope of the present disclosure. It should be understood that features and/or operations described with respect to one example may be used with other examples and that not all examples of the present disclosure have all of the features and/or operations illustrated in a particular figure or described with respect to one of the examples. Variations of examples described will occur to persons of the art. Furthermore, the terms "comprise," "include," "have" and their conjugates, shall mean, when used in the present disclosure and/or claims, "including but not necessarily limited to."

It is noted that some of the above described examples may include structure, acts or details of structures and acts that may not be essential to the present disclosure and are intended to be exemplary. Structure and acts described herein are replaceable by equivalents, which perform the same function, even if the structure or acts are different, as known in the art. Therefore, the scope of the present disclosure is limited only by the elements and limitations as used in the claims.

What is claimed is:

1. A drying apparatus usable with a printing system, the drying apparatus comprising:

a housing having a front region and a rear region adjacent to the front region, the front region including an inlet to receive media and the rear region including an outlet to pass media there through;

a first set of radiative heating elements disposed within the front region to heat the media;

a second set of radiative heating elements disposed within the rear region to heat the media, such that the first set of radiative heating elements and the second set of radiative heating elements are arranged sequentially along a media transport path between the inlet and the outlet; and an air handling device disposed across from the second set of radiative heating elements to jet air within the rear region, the air handling device being oriented to jet air toward a surface of the media to cool the media prior to the media being passed through the outlet.

2. The drying apparatus of claim 1, wherein the air handling device comprises:

a plurality of air bars, each air bar includes a plurality of nozzles to jet the air at the media.

3. The drying apparatus of claim 2, wherein a respective air velocity of the air jetted from each of the nozzles of a respective air bar are uniform with respect to each other and support the media within the housing.

4. The drying apparatus of claim 1, wherein the air handling device is configured to jet the air at a velocity in a range from 40 to 90 meters per second.

5. The drying apparatus of claim 2, wherein the housing further comprises:

wherein the air bars are disposed between the media transport path and the second set of radiative heating elements.

6. The drying apparatus of claim 1, wherein a media exit temperature of the media passing through the outlet is lower than a front region media temperature of the media within the front region.

7. The drying apparatus of claim 1, wherein the media exit temperature of the media exiting the outlet is in a range from 60 to 75° C.

8. A printing system, comprising:

a printing station including at least one printhead to print on a media to form a printed media;

a first drying station upstream from the printing station in a media transport direction to heat the media before the media is printed on by the printing station, the first drying station including:

a housing having a front region and a rear region adjacent to the front region, the front region including an inlet to receive the media and the rear region including an outlet to pass the media there through;

a first set of radiative heating elements disposed within the front region to heat the media;

a second set of radiative heating elements disposed within the rear region to heat the media; and a plurality of air bars disposed across from the second set of radiative heating elements in which each air bar includes a plurality of nozzles to jet air within the rear region to cool the media prior to the media being passed through the outlet.

9. The printing system of claim 8, wherein the first drying station further comprises:

a media transport path; and wherein the air bars are disposed between the media transport path and the second set of radiative heating elements to jet the air at a velocity in a range from 40 to 90 meters per second.

10. A method for drying media, comprising:

receiving media through an inlet of a front region of a housing;

heating the media in the front region of the housing by a first set of radiative heating elements disposed therein;

heating the media in a rear region including an outlet of the housing adjacent to the front region by a second set of radiative heating elements disposed within the rear region; and jetting air within the rear region by an air handling device disposed across from the second set of radiative heating elements to cool the media prior to the media being passed through the outlet such that a media exit temperature of the media exiting the outlet is lower than a front region media temperature of the media when positioned in the front region.

11. The method of claim 10, wherein the jetting air within the rear region by an air handling device further comprises:

jetting the air at an air velocity from each of the nozzles of a respective air bar of the air handling device in a uniform manner with respect to each other to support the media within the housing.

12. The method of claim 10, wherein the jetting air within the rear region by an air handling device further comprises:

jetting the air at a velocity in a range from 40 to 90 meters per second.

13. The method of claim 10, wherein the heating the media in the front region of the housing by a first set of radiative heating elements disposed therein and the heating the media in a rear region by a second set of radiative heating elements disposed within the rear region are performed to preheat the media prior to the media being printed on.

14. The method of claim 10, wherein the jetting air within the rear region by an air handling device further comprises:

lowering vapor pressure in an area adjacent to the media and within the rear region.

15. The method of claim 10, wherein the jetting air within the rear region by an air handling device further comprises:

increasing a mass transfer coefficient and a heat transfer coefficient of the rear region.

16. The drying apparatus of claim 2, wherein the plurality of air bars are arranged in parallel across and perpendicular to the media transport path.

17. The drying apparatus of claim 2, wherein the plurality of air bars are connected to a common air manifold.

18. The printing system of claim 8, further comprising a second drying station including a heater to heat the printed media.

19. The printing system of claim 8, further comprising a rewinding station to rewind printed media.

20. The method of claim 10, further comprising directing the jetted air at the media to cool the media.

* * * * *